US008065901B2

(12) United States Patent
Iida et al.

(10) Patent No.: US 8,065,901 B2
(45) Date of Patent: Nov. 29, 2011

(54) MANDREL BAR FOR HIGH-ALLOY ROLLING, METHOD FOR SURFACE TREATING A MANDREL BAR, METHOD FOR PRODUCING MANDREL BAR, AND METHOD FOR OPERATING SEAMLESS PIPE MILL

(75) Inventors: Sumio Iida, Takanazuka (JP); Yasuyoshi Hidaka, Kobe (JP); Mitsuru Yoshizawa, Anagasaki (JP); Koji Nakaike, Wakayama (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/236,970

(22) Filed: Sep. 24, 2008

(65) Prior Publication Data

US 2009/0071221 A1 Mar. 19, 2009

Related U.S. Application Data

(63) Continuation of application No. PCT/JP2007/056676, filed on Mar. 28, 2007.

(30) Foreign Application Priority Data

Mar. 28, 2006 (JP) ..... 2006-088513

(51) Int. Cl.
*B21B 17/10* (2006.01)

(52) U.S. Cl. ..... 72/208; 72/364; 72/462; 72/700

(58) Field of Classification Search ..... 72/96, 97, 72/208, 209, 342.1, 365.2, 366.2, 370.01, 72/700, 47, 53, 364, 462
See application file for complete search history.

(56) References Cited

U.S. PATENT DOCUMENTS

| | | | | |
|---|---|---|---|---|
| 4,827,750 | A * | 5/1989 | Hayashi | 72/97 |
| 4,886,640 | A * | 12/1989 | Garner et al. | 420/111 |
| 5,218,851 | A * | 6/1993 | Imae | 72/208 |
| 6,267,828 | B1 * | 7/2001 | Kushida et al. | 148/334 |
| 7,100,410 | B2 * | 9/2006 | Yamakawa et al. | 72/97 |
| 7,165,431 | B2 * | 1/2007 | Iida et al. | 72/208 |
| 2008/0047317 | A1 * | 2/2008 | Sasaki | 72/209 |

FOREIGN PATENT DOCUMENTS

| | | | |
|---|---|---|---|
| JP | 54-17363 | * | 2/1979 |
| JP | 57-103714 | * | 6/1982 |
| JP | 63-235491 | * | 9/1988 |
| JP | 01-170502 | | 7/1989 |
| JP | 3-240921 | * | 10/1991 |
| JP | 06-262220 | | 9/1994 |
| JP | 06-339709 | | 12/1994 |
| JP | 8-164404 | * | 6/1996 |
| JP | 8-197112 | * | 8/1996 |
| JP | 11-226614 | * | 8/1999 |
| JP | 2000-246312 | * | 9/2000 |
| JP | 2000-351007 | * | 12/2000 |
| JP | 2001-1016 | * | 1/2001 |
| JP | 2004-344923 | * | 12/2004 |

OTHER PUBLICATIONS

International Search Report in corresponding PCT/JP2007/056676 dated Jun. 19, 2007.

Written Opinion in corresponding PCT/JP2007/056676 dated Jun. 19, 2007 (Japanese).

International Preliminary Report on Patentability from the International Bureau of WIPO, dated Oct. 21, 2008.

* cited by examiner

*Primary Examiner* — Edward Tolan

(74) *Attorney, Agent, or Firm* — Marshall, Gerstein & Borun LLP

(57) ABSTRACT

A method for surface treating a mandrel bar used for hot rolling of high-alloy seamless steel pipe is provided. The method includes heat treating the mandrel bar to develop a scale, and after heat treatment, rolling ordinary steel comprising 8% or less of chromium for at least 50 passes. This achieves a mandrel bar for rolling high-alloy steel possessing both durability and superior resistance to seizure.

3 Claims, No Drawings

MANDREL BAR FOR HIGH-ALLOY ROLLING, METHOD FOR SURFACE TREATING A MANDREL BAR, METHOD FOR PRODUCING MANDREL BAR, AND METHOD FOR OPERATING SEAMLESS PIPE MILL

The disclosure of International Application No. PCT/JP2007/056676 filed Mar. 28, 2007 including specification, drawings and claims is incorporated herein by reference in its entirety.

TECHNICAL FIELD

The present invention relates to a mandrel bar, a method for surface treating the mandrel bar, a method for producing the mandrel bar, and a method for operating a seamless pipe mill.

BACKGROUND ART

Mandrel mill rolling is a step in the process for producing seamless pipes or tubes by hot working. A hollow shell is rolled by being axially transferred through multiple stands of grooved-rolls while supported on a mandrel bar. The surface of the mandrel bar is usually coated with lubricant that is solid lubricant. Satisfactory lubrication is difficult because the mandrel bar undergoes harsh sliding friction against the inner surface of the shell. This type of rolling damages the surface of the mandrel bar resulting in repeated friction, seizure, roughening, or cracking that shortens the mandrel bar service life.

The mandrel bar is made of hot working tool steel such as SKD6 and SKD61. The steel used for a mandrel bar is polished on its surface and then quenched and tempered in order to adjust the hardness and develop a scale on the surface.

Recent rising demand for high-alloy steel pipes such as of 13% chromium steel has revealed some problems, one of which is seizure on the mandrel bar. That is because high alloy steel has high deformation resistance and it is difficult to form oxidized scale on the inner surface of the hollow shell made of the high alloy steel. Such problems are handled by applying lubricant to the surface of the mandrel bar during rolling of the high alloy steel, though seizure cannot be avoided altogether. The seizure might cause oscillations during rolling, exerting adverse effects on finished dimensions and causing mandrel bar stripping defects. This seizure results in axial streaking flaws occurring on the inner surface of the hollow shell that require a large amount of time and money to repair.

Patent document 1 proposes a mandrel bar for manufacturing hot-worked seamless tube having a nitride treated layer with an average roughness of 0.5 to 5.0 μm along the axial center line of the surface of its base material in order to resolve these problems.

Patent document 2 proposes a method for producing a piercing mandrel bar for rolling seamless stainless tube characterized by the following steps;

diffusing Cu, Zn, Al, or an alloy thereof over the frictional surface of a mandrel bar formed in a piercing shape for use in rolling seamless steel tube, thereby embrittling the grain boundaries on the frictional surface and subjecting heat treatment for thermal refining; or generating fine hexagonal surface cracking on the embrittled grain boundaries by rapid heating at high temperature in the initial rolling stage.

[Patent document I] Japanese Unexamined Patent Application Publication No. 6-262220

[Patent document 2] Japanese Unexamined Patent Application Publication No. 6-339709

DISCLOSURE OF THE INVENTION

Problems to be Solved by the Invention

Production of the mandrel bar proposed in patent document 1 requires a costly investment in equipment. In addition, thickening the surface treated layer takes an extensive period of time which makes the mandrel bar of patent document 1 impractical.

The method disclosed in patent document 2 is not practical for actual use due to the possibility of breakage.

An object of the present invention is to provide a method for surface treating and a method for producing a high-alloy rolling mandrel bar (which is used for producing seamless steel pipes with Mannesmann mandrel mill) having superior seizure resistance and durable service life. Another object of the present invention to provide a method for operating a seamless pipe mill capable of rolling high alloy steel as well as ordinary steel without seizures.

Means to Solve the Problems

In order to achieve the above objects, the present inventors made a careful investigation of mandrel bars in the workplace and conducted various studies for improving mandrel bars durability which revealed the following.

(A) Seizure is likely to occur when rolling high alloy steel especially on a new mandrel bar.

(B) Careful observation of seized mandrel bars revealed that they have no scale or lubricant at the seizure section and the metal is exposed, suggesting that preventing metal exposure leads to preventing seizure.

In a further study based on these findings, the present inventors found that the metal exposure could be prevented by use of the mandrel bar several times for rolling ordinary steel containing 8% or less of chromium. The seizure is less likely to be generated during rolling of high alloy steel by using such mandrel bar.

The present invention can be summarized into (1) a mandrel bar used for rolling high alloy steel, (2) a method for surface treating a mandrel bar used for rolling high alloy steel, (3) a method for producing a mandrel bar for rolling high alloy steel, and (4) a method for operating a seamless pipe mill which are described as follows.

(1) A mandrel bar for rolling high alloy steel, which was used for rolling ordinary steel comprising 8% or less of chromium for a least 50 passes after a heat treatment for developing a scale.

(2) A method for surface treating a mandrel bar for hot rolling of high-alloy seamless steel pipe characterized by following steps:

subjecting a heat treatment to develop a scale on the mandrel bar, and then using the mandrel bar for rolling ordinary steel comprising 8% or less of chromium for a least 50 passes.

(3) A method for producing a mandrel bar for hot rolling of high-alloy seamless steel pipe characterized by following steps:

subjecting a heat treatment to develop a scale on the mandrel bar, and then using the mandrel bar for rolling ordinary steel comprising 8% or less of chromium for a least 50 passes.

(4) A method for operating a seamless pipe mill characterized by the following steps:

using a mandrel bar heat treated to develop a scale for rolling ordinary steel comprising 8% or less of chromium for a least 50 passes, and using the mandrel bar for rolling high alloy steel.

Effects of the Invention

The present invention achieves a mandrel bar for high-alloy rolling having superior seizure resistance and a durable service life. This mandrel bar for high-alloy rolling is particularly useful for mandrel mill rolling conditions-demanding stainless steel such as 13% chromium steel into seamless steel pipes. Also, the method of the invention for operating a seamless pipe mill is capable of rolling high alloy steel as well as ordinary steel without seizures. The method also extends the service life of a mandrel bar by improving durability to save the trouble of tool replacement, thereby contributing to lower manufacturing costs.

BEST MODE FOR CARRYING OUT THE INVENTION

The mandrel bar for high-alloy rolling according to the present invention is produced from a base material such as SKD 6 and SKD 61 alloy tool steel, which is cut on the exterior and polished or shot peened, and then surface treated. Prior to external cutting, the steel is usually quenched at 950 to 1050° C. and then tempered at 600 to 750° C.

The surface treating includes heat treatment to develop a scale and, after the heat treatment, ordinary steel containing 8% or less of chromium is rolled by the mandrel bar in at least 50 passes.

If the surface roughness Ra of pre-treated base material is less than 0.2, the scale will not have sufficient adhesion, and might be stripped away from the tool steel during the surface treatment process. If the surface roughness Ra exceeds 4.0, the protrusions on the rough surface might cut into the rolled material, resulting in a higher frictional coefficient. In view of this, the surface roughness of the pre-treated base material is preferably in a range from 0.2 to 4.0.

A scale is formed by heat treating in order to prevent metal exposure during rolling of ordinary steel that usually contains 8% or less chromium.

There are no particular restrictions on the heat treatment for the mandrel bar for scale development. However, the desired effect is insufficient at lower than 550° C. while the mandrel bar might soften in excess of 750° C. In view of these circumstances, the temperature of the heat treatment is preferably in the range of 550 to 750° C. During the heat treatment period, less than one hour is not sufficient to achieve adequate scale adhesion while a period longer than 15 hours might soften the mandrel bar. In view of these circumstances, the heat treatment period is preferably in a range from 1 to 15 hours.

Rolling ordinary steel containing 8% or less chromium in at least 50 passes prevents metal exposure. While this prevention mechanism is not fully understood, a possible explanation is that the rolling causes scale (coating) from the ordinary steel to adhere to the surface of the mandrel bar, and in this way improve the scale adhesion by rolling.

The elongation ratio of the ordinary steel is preferably adjusted to 1.5 or more during rolling. The reason is that a ratio that is lower than 1.5 provides insufficient pressing force, resulting in an insufficient scale transfer. A low ratio also possibly results in inadequate adhesive force. A ratio below 1.5 is also detrimental to productivity since extra tasks are required for surface treatment.

Rolling steel that contains chromium in excess of 8% strips away the scale formed by heat treatment, resulting in metal exposure. In view of this, ordinary steel whose chromium content is 8% or less is used for rolling. Preferably, the chromium content is 5% or less.

If the ordinary steel is not rolled enough times then a coating cannot be formed throughout the mandrel bar, thereby failing to completely eliminate seizure during rolling of high alloy steel. In view of this, the rolling is performed in at least 50 passes. As large a number of passes as possible especially 100 passes or more is preferable for rolling the ordinary steel.

However, making too many passes when rolling ordinary steel whose chromium content is relatively large even though within 8% could reduce the amount of scale formed on the surface of the rolled material. In view of this, the following restrictions are placed on the number of passes on ordinary steel. These restrictions are divided into three groups A to C. There are no restrictions on steel group A. Steel group B is limited to 40 passes or less. Steel group C is limited to 15 passes or less.

Steel group A: Ordinary steel having a chromium content of less than 0.5%.

Steel group B: Ordinary steel having a chromium content of 0.5% or more and less than 5.0%.

Steel group C: Ordinary steel having a chromium content of 5.0 or more and 8% or less.

During seamless pipe mill operation, ordinary steel with a chromium content of 8% or less is first rolled in at least 50 passes by using a mandrel bar provided with the scale by heat treatment. Then high alloy steel is rolled by using the mandrel bar. This operation method allows rolling high alloy steel as well as ordinary steel under conditions that will not cause seizure. The method also extends the durable service life of the mandrel bar to save the time and labor required for tool replacement, thereby helping to lower the manufacturing cost.

The operation method may include rolling ordinary steel having a chromium content of 8% or less, and subsequently rolling high alloy steel. Alternatively, the mandrel bar that made 50 passes on ordinary steel may be separately prepared for rolling high alloy steel.

The surface of the mandrel bar might deteriorate due to considerable rolling of high alloy steel even if the mandrel bar was subjected to the surface processing of this invention. In such cases, the surface of the mandrel bar can be subjected to external cutting and grinding, and if necessary the surface processing of this invention performed by making at least 50 passes of the mandrel bar on ordinary steel with a chromium content within 8% after heat treating to form a scale.

EXAMPLES

SKD 61 material was polished to adjust its surface roughness Ra to 0.4, and then heat treated to adjust its hardness to Shore hardness Hs of 50 to 55. This material was then cut to an outer diameter of 134 mm, thus obtaining a mandrel bar. This mandrel bar was used in a mandrel mill to roll shells each having an outer diameter Φ of 181 mm, a thickness t of 17.5 mm, and a length L of 7000 mm into seamless steel pipes each having an outer diameter Φ of 147 mm, a thickness t of 6.5 mm, and a length L of 21000 mm. The rolled materials were ordinary steel, alloy steel, and high alloy steel as described in Table 1.

TABLE 1

| | | Break-in rolling | | | | | | | High alby rolling Steels | |
|---|---|---|---|---|---|---|---|---|---|---|
| | | Steels | | | | | | | | SUS420 |
| Classification | No | S10C 0.1C steel | S22C 0.22C steel | S48C 0.48C steel | SCM415 1Cr—0.2Mo steel | STBA24 2Cr—1Mo steel | STPA25 5Cr steel | Total | STPA26 9Cr steel | JI 13Cr steel |
| Inventive Examples | 1 | | 50 | | | | | 50 | | 22 |
| | 2 | | 70 | | | | | 70 | 26 | |
| | 3 | | 100 | | | | | 100 | >30 | |
| | 4 | | 150 | | | | | 150 | | >30 |
| | 5 | 20 | 25 | | 25 | | | 70 | 28 | |
| | 6 | 30 | 35 | | | 30 | 15 | 110 | | >30 |
| | 7 | 20 | | 30 | | | | 50 | | 21 |
| | 8 | 15 | | | | 35 | | 50 | 23 | |
| | 9 | | 10 | 25 | | 35 | 10 | 80 | | 29 |
| | 10 | | 10 | 15 | 20 | | 5 | 50 | | 22 |
| | 11 | | 10 | | 30 | 10 | | 50 | | 24 |
| | 12 | | | 80 | | 15 | 5 | 100 | >30 | |
| Comparative Examples | 1 | | | | | | | 0 | | 3 |
| | 2 | | 30 | | | | | 30 | 10 | |
| | 3 | 10 | | 15 | | | | 25 | | 9 |
| | 4 | | 10 | | | 20 | | 30 | | 11 |
| | 5 | | | 5 | 15 | | | 20 | | 6 |

Table 1 shows the number of successful passes of rolling achieved between the start of high alloy steel rolling and the occurrence of troubles such as oscillation and stripping.

As shown in Table 1, inventive examples 1 to 12 all achieved 21 or more passes or high alloy steel rolling. In particular, inventive examples 3, 4, 6, and 12, which made 100 or more break-in rolling passes, achieved more than 30 high alloy steel rolling passes. The comparative examples on the other hand, all encountered troubles before completing 11 passes.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention allow manufacturing mandrel bars capable of rolling high alloy steel and also possessing a durable service life and excellent resistance to seizure. This high-alloy rolling mandrel bar is particularly useful for manufacturing seamless steel pipes by mandrel mill rolling of stainless steel under harsh conditions-such as requiring 13% chromium steel. The inventive method for operating a seamless pipe mill also rolls high alloy steel, as well as ordinary steel without seizures. The method also extends the durable service life of the mandrel bar to save the time and labor required for tool replacement, thereby helping to lower the manufacturing cost.

The invention claimed is:

1. A method for surface treating a mandrel bar, which is produced from SKD6 or SKD61 alloy tool steel, comprising the steps of: adjusting a surface roughness Ra of the mandrel bar in a range from 0.2 to 4.0; subjecting a heat treatment to develop a scale on the mandrel bar; and using the mandrel bar for rolling ordinary steel pipe comprising 8% or less of chromium for at least 50 passes in total, but rolling ordinary steel pipe comprising a chromium content of 0.5% or more and less than 5.0% for 40 passes or less, and rolling ordinary steel pipe comprising a chromium content of 5.0 or more and 8% or less for 15 passes or less with adjusting an elongation ratio to 1.5 or more.

2. A method for manufacturing a high alloy seamless steel pipe, comprising a rolling process with a mandrel bar produced by the steps of:

adjusting a surface roughness Ra of the mandrel bar in a range from 0.2 to 4.0;

subjecting a heat treatment to develop a scale on the mandrel bar, and;

using the mandrel bar for rolling ordinary steel pipe comprising 8% or less of chromium for at least 50 passes with adjusting an elongation ratio to 1.5 or more.

3. The method according to claim 2, using the mandrel bar for rolling ordinary steel pipe comprising 8% or less of chromium for at least 50 passes in total, but rolling ordinary steel pipe comprising a chromium content of 0.5% or more and less than 5.0% for 40 passes or less, and rolling ordinary steel pipe comprising a chromium content of 5.0 or more and 8% or less for 15 passes or less.

* * * * *